US005881419A

United States Patent [19]

Millard

[11] Patent Number: 5,881,419

[45] Date of Patent: Mar. 16, 1999

[54] HOSE CLEANER AND HOLDER

[75] Inventor: John E. Millard, Pismo Beach, Calif.

[73] Assignee: Hose Minder, Pismo Beach, Calif.

[21] Appl. No.: 997,226

[22] Filed: Dec. 23, 1997

[51] Int. Cl.[6] ..... G08B 1/00

[52] U.S. Cl. ..... 15/104.04; 15/40; 15/210.1; 15/244.1; 15/220.4; 248/80

[58] Field of Search ..... 15/40, 104.04, 15/210.1, 211, 220.4, 244.1, 245, 256.6; 248/80

[56] References Cited

U.S. PATENT DOCUMENTS

| | | | |
|---|---|---|---|
| 1,164,156 | 12/1915 | Yeager | 15/210.1 |
| 1,996,299 | 4/1935 | Layland | 15/210.1 |
| 2,197,596 | 4/1940 | Short | 15/210.1 |
| 2,550,487 | 4/1951 | MacClatchie | 15/220.4 |
| 2,916,758 | 12/1959 | Hamilton | 15/220.4 |
| 3,189,935 | 6/1965 | Euga | 15/104.04 X |
| 4,084,287 | 4/1978 | Ingram et al. | 15/210.1 |
| 5,647,084 | 7/1997 | Still et al. | 15/40 X |

*Primary Examiner*—Mark Spisich
*Attorney, Agent, or Firm*—Townsend and Townsend and Crew LLP

[57] ABSTRACT

A hose cleaner comprises a resilient portion supported by a support portion and having an opening extending therethrough. A dirty hose having a size larger than the opening is inserted through the opening and pulled therethrough. The opening of the resilient portion is compressed around the exterior of the hose and removes the dirt and debris from the exterior of the hose. The hose cleaner also functions as a hose holder for supporting and guiding the hose for additional purposes.

13 Claims, 5 Drawing Sheets

HOSE CLEANER AND HOLDER

BACKGROUND OF THE INVENTION

Hoses are used for a variety of applications, such as outdoor garden hoses for watering and indoor cleaning hoses connected to a cleaner for cleaning carpets and the like. When hoses are used, dirt tends to cling to the outer surfaces of the hoses. The dirt may be clipped grass and mud from the lawn, or dust and crumbs on the carpet in the house. It is desirable to clean the exterior of the hose in some situations to prevent tracking dirt into clean areas. Simply rinsing the hose to clean it may be too time-consuming or otherwise impractical, and the wet hose is likely to pick up additional dirt.

SUMMARY OF THE INVENTION

The present invention provides a hose cleaner that is easy to operate and effectively cleans the exterior of hoses without the need for large amounts of water. The hose cleaner can also be used as a hose holder to hold a hose, for instance, to control the hose at high pressure, to guide the movement of the hose to protect flowerbeds, or to support a hose used for watering. The hose holder may be used to prevent the sprinkler hose from twisting and misdirecting the water. The hose holder may also prevent a hose from "snaking" when one turns on the water.

In accordance with an aspect of the present invention, a hose cleaner for cleaning the exterior of a hose comprises a resilient portion coupled to a support portion. The resilient portion includes a resilient, deformable material and a resilient opening being smaller in size than the exterior of the hose for receiving the hose.

In accordance with another aspect of the invention, a hose cleaner and holder for use with a hose comprises a resilient member and means for supporting the resilient member relative to the hose. The resilient member comprises a deformable resilient opening for receiving and pressing against the exterior of the hose.

Yet another aspect of this invention is a method of cleaning a hose using a resilient member made of a resilient material and having an opening which is smaller in size than the exterior of the hose. The method comprises the steps of supporting the resilient member relative to the hose and inserting an end of the hose through the opening of the resilient member. The hose is pulled through the opening of the resilient member.

BRIEF DESCRIPTION OF THE DRAWINGS

The preferred embodiments of this invention, illustrating all their features, will now be discussed in detail. These embodiments depict the novel and nonobvious hose cleaner and holder of this invention shown in the accompanying drawings, which are included for illustrative purposes only. These drawings include the following figures, with like numerals indicating like parts.

DETAILED DESCRIPTION OF THE INVENTION

Figure 4:
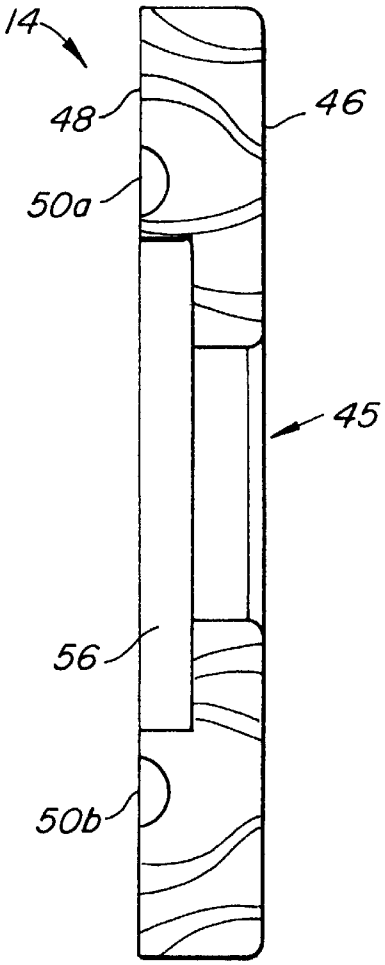
FIG. 4 is a cross-sectional view of the rear section of the hose cleaner and holder of FIG. 3 along IV—IV.
Figure 5:
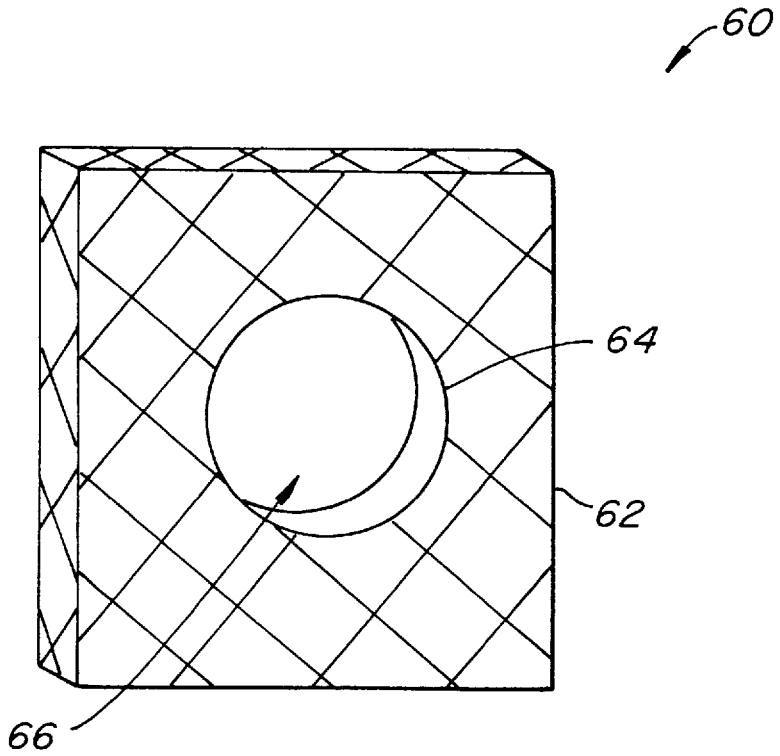
FIG. 5 is a perspective view of a resilient member of the hose cleaner and holder in accordance with an aspect of the present invention.
Figure 6:
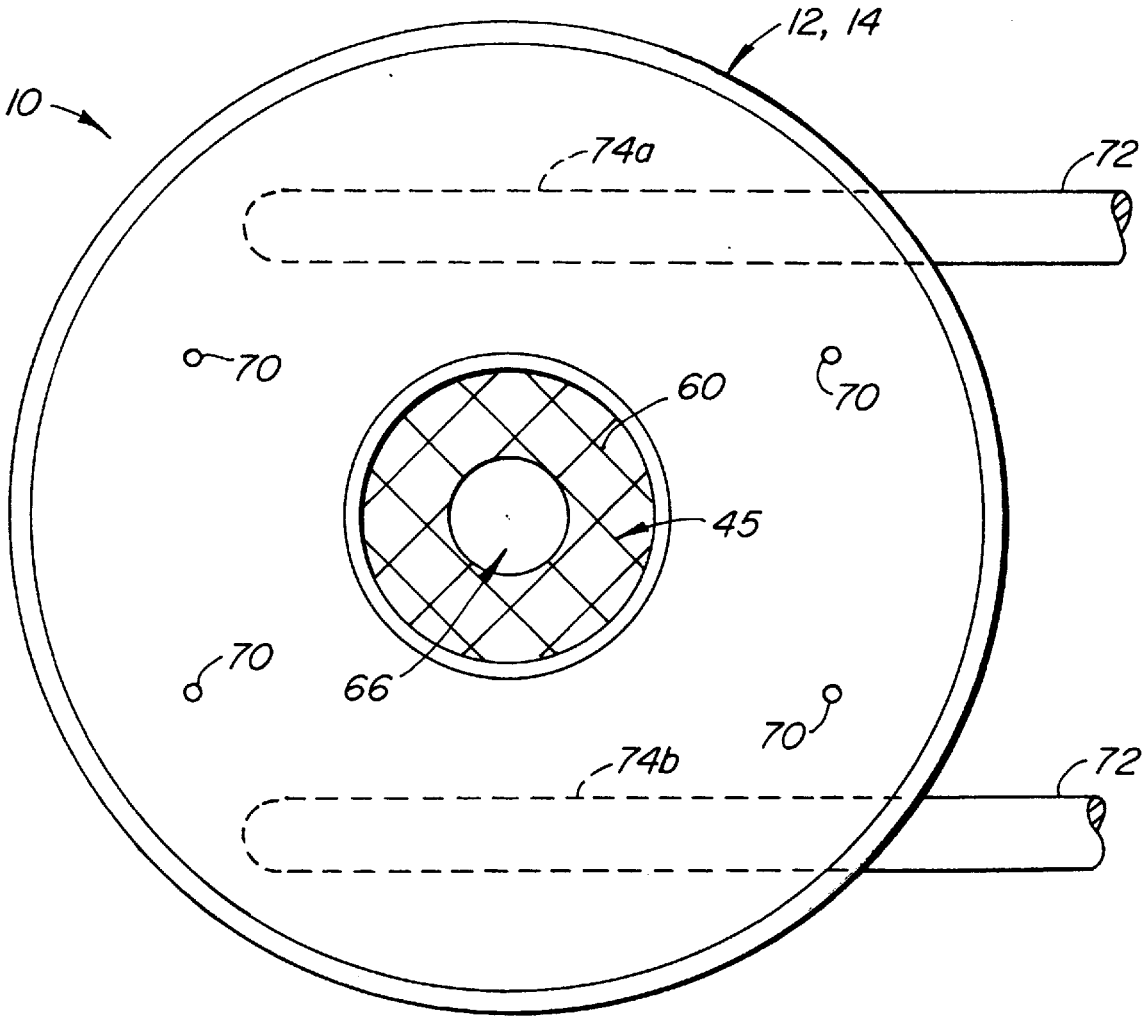
FIG. 6 is an elevational view of the hose cleaner and holder comprising the front section of FIG. 1, the rear section of FIG. 3, and the resilient member of FIG. 5.

FIGS. 1–5 show components that are assembled to form a hose cleaner 10 illustrated in FIG. 6. The hose cleaner 10 comprises a front section 12 of FIGS. 1 and 2 and a rear section 14 of FIGS. 3 and 4. The front section 12 and rear section 14 are coupled to the support resilient member 60 shown in FIG. 5.

Figure 2:
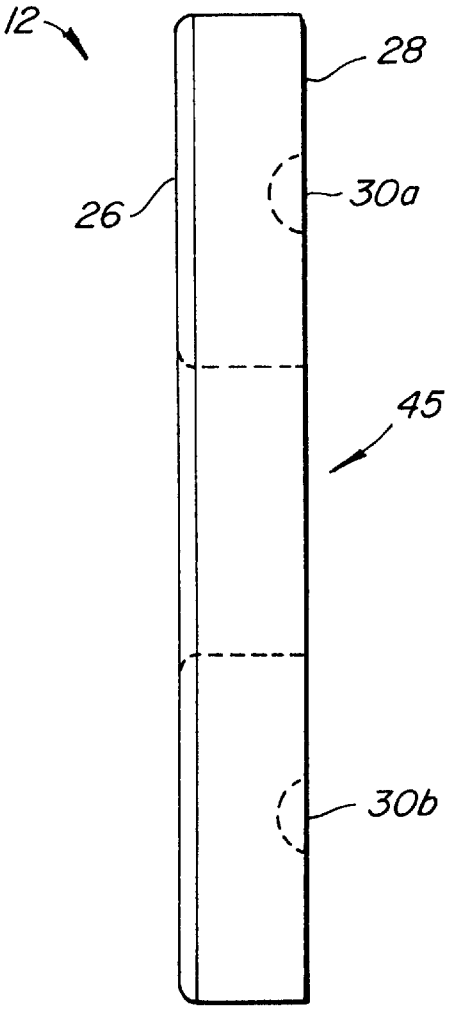
FIG. 2 is a side elevational view of the front section of the hose cleaner and holder of FIG. 1.
Figure 1:
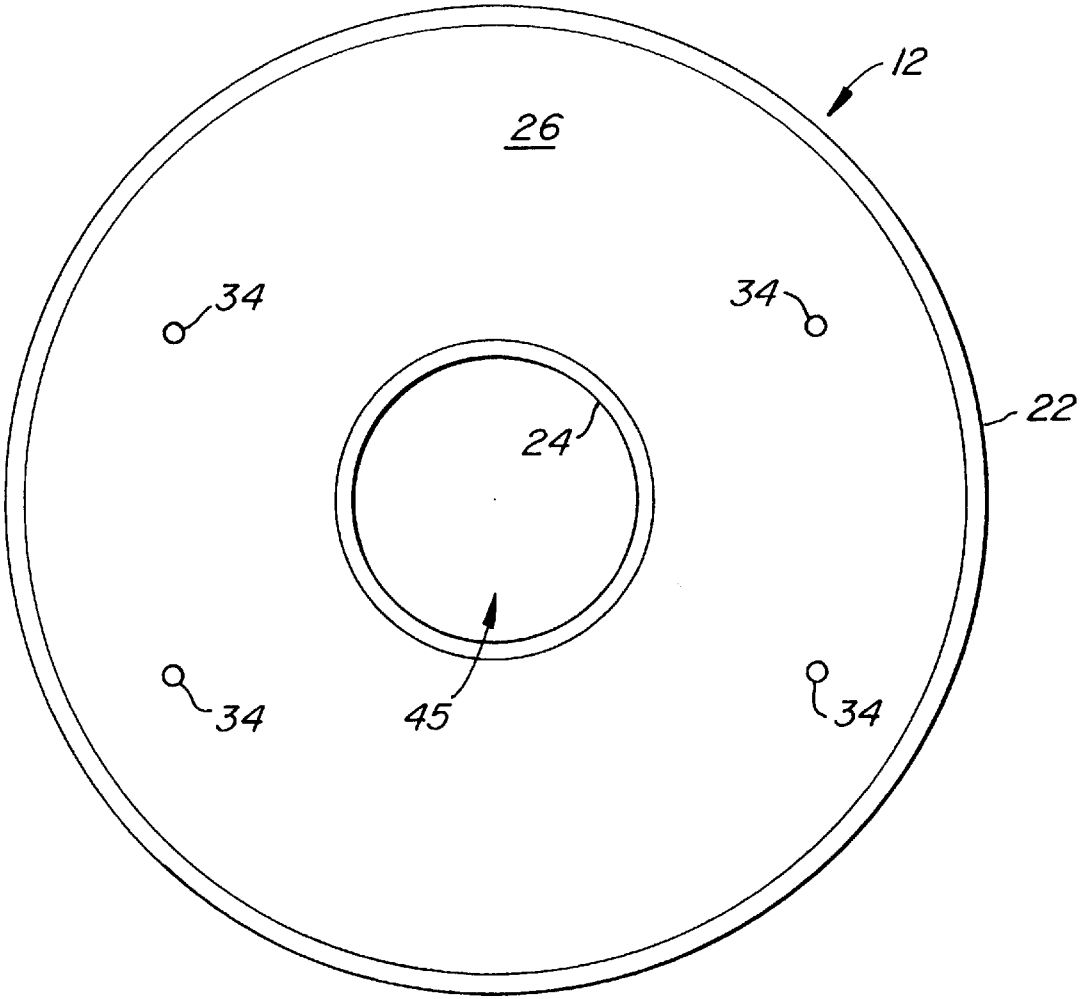
FIG. 1 is a front elevational view of a front section of a hose cleaner and holder in accordance with an aspect of the present invention.

Referring to FIGS. 1 and 2, the front section 12 has a generally circular outer edge 22 and a generally circular inner edge 24. The outer edge 22 and inner edge 24 may be rounded at the front surface 26 as shown. At the rear surface 28 are a pair of front grooves 30*a*, 30*b* which will be discussed in more detail below. The front section 12 further includes four apertures 34 extending through its thickness. The number of the apertures 34 may be different in other embodiments.

Figure 3:
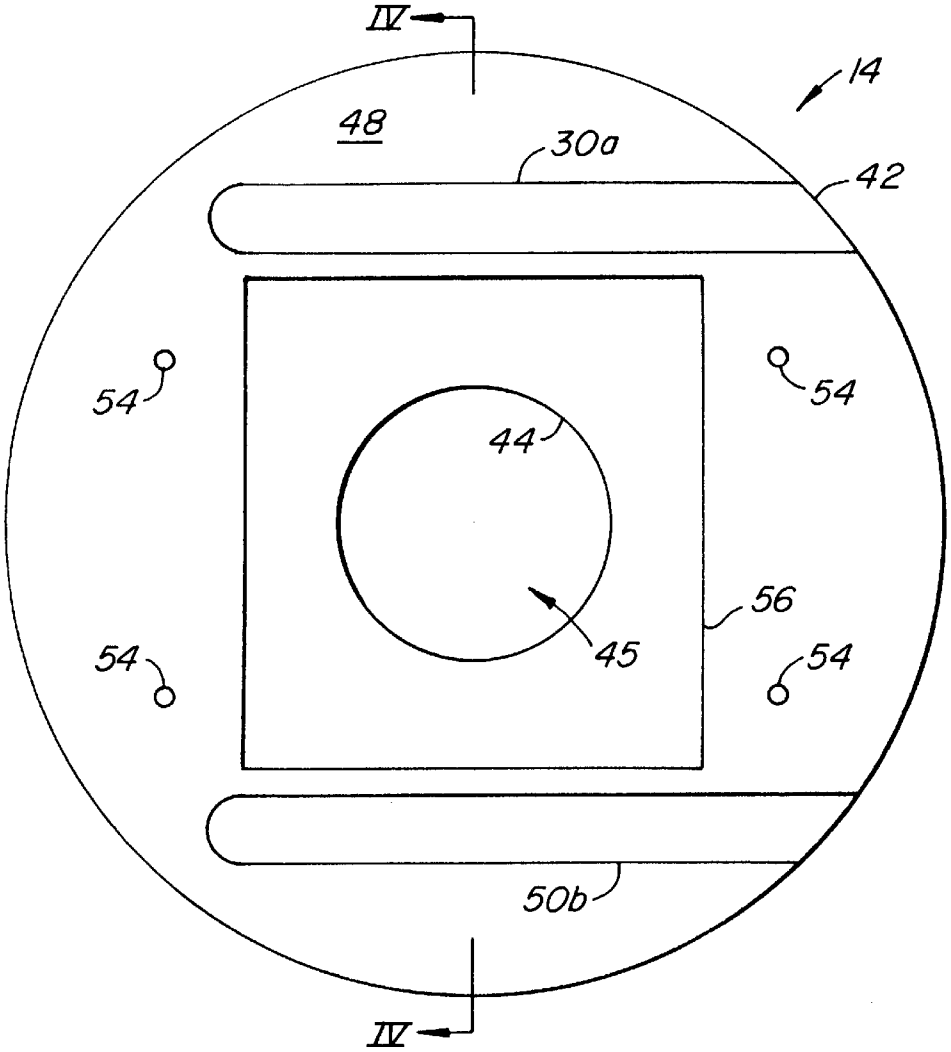
FIG. 3 is a front elevational view of a rear section of the hose cleaner and holder of FIG. 1.

The rear section 14 shown in FIGS. 3 and 4 has a generally circular outer edge 42 that matches the outer edge 22 of the front section 12, and a generally circular inner edge 44 that matches the inner edge 24 of the front section 12. The inner edges 44 and 24 define a support opening 45 extending therethrough. The outer edge 42 and inner edge 44 may be rounded at the rear surface 46. The front surface 48 includes a pair of rear grooves 50*a*, 50*b* that may be parallel as shown. The rear grooves 50*a*, 50*b* are generally identical to and match the front grooves 30*a*, 30*b*, and together form a pair of cylindrical channels, which will be discussed in connection with FIG. 6 below. The rear section 14 comprises four part-through apertures 54 that match the four apertures 34 of the front section 12. A generally rectangular cavity 56 is formed at the front surface 48. The dimensions shown in FIGS. 3 and 4 are for illustrative purposes only, and do not limit the present invention.

The rectangular cavity 56 of the rear section 14 is used to house a resilient member 60 shown in FIG. 5. The resilient member 60 is a generally planar member having a rectangular outer edge 62 and a generally circular inner edge 64. The inner edge 64 defines a deformable resilient opening 66 that is smaller in size than the support opening 45 formed by the front and rear sections 12, 14. The resilient member 60 comprises a resilient, deformable material such as rubber. The resilient material may be a sponge-like material that absorbs water. The resilient opening 66 may have other shapes instead. The size of the resilient opening 66 is smaller than the size of hoses with which the hose cleaner 10 is used. The relative sizes depend largely on the deformable characteristics of the resilient portion 60. In one example, the resilient portion 60 is made of rubber, desirably water permeable sponge rubber such as the sponge rubber per ASTMD-1056 available from H. C. Lien Rubber Company of Los Angeles, Calif. In the example, the sponge rubber is about ¾ inch thick and has an outer diameter of about 13/16 inch, and the resilient opening 66 has a diameter of about ⅝ inch, for use with hoses of sizes ½ to ¾ inch with outer diameters that range from about ⅝ to 1-⅛ inches.

In assembly, the resilient portion 60 is placed in the cavity 56 of the rear section 14. The rear surface 28 of the front section 12 is disposed opposite the front surface 48 of the rear section 14 with the apertures 34 of the front section 12 aligned with the part-through apertures 54 of the rear section 14. The front section 12 and rear section 14 form a support portion of the hose cleaner 10. As shown in the assembled hose cleaner 10 of FIG. 6, four screws 70 are used to secure the front section 12 and rear section 14. Other types of fasteners may be used instead. Prior to applying the screws 70, a pair of support legs 72 may be inserted into the cylindrical channels 74*a*, 74*b* formed by the front grooves 30*a*, 30*b* of the front section 12 and the rear grooves 50*a*, 50*b* of the rear section 14. The sizes of the channels 74*a*, 74*b* may be slightly smaller than the sizes of the legs 72. When the two sections 12, 14 are fastened together, the undersized channels 74*a*, 74*b* form tight fits to secure or clamp the legs 72 to the support portion formed by the front section 12 and rear section 14. The front and rear sections 12, 14 are made of a substantially rigid material, such as wood, metal, hard plastic, and the like. The support legs 72 may also be made of a similar material.

It is noted that the support portion formed by the front section 12 and rear section 14 may be made as a unitary component. In that case, the resilient member 60 can be inserted into the cavity 56 by deforming the member 60. No screws are need. The support legs 72 may be inserted into the channels 74*a*, 74*b* by force using a hammer. In addition, the shapes of the components of the hose cleaner 10 may vary in other embodiments.

Figure 7:
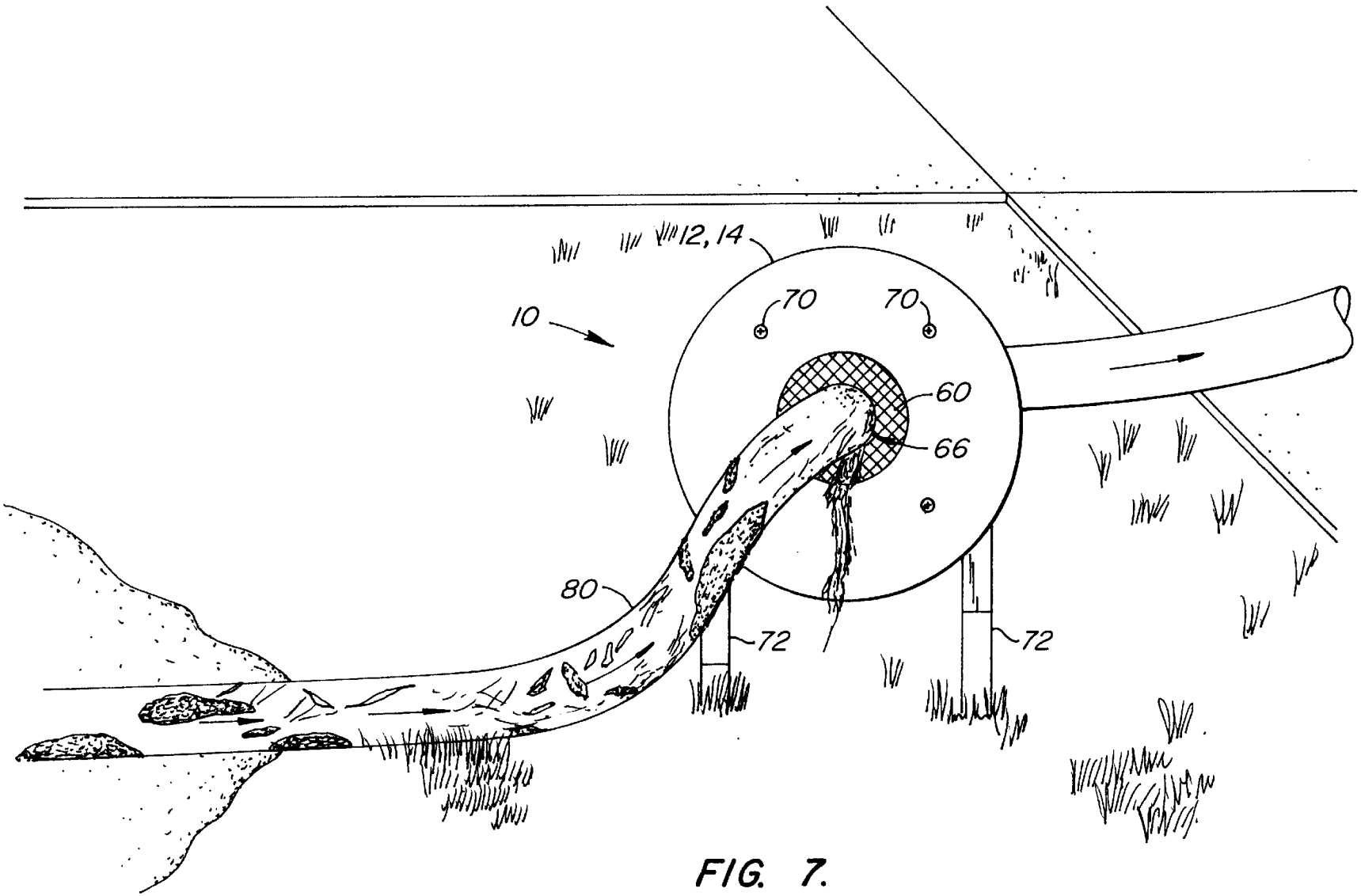
FIG. 7 is an elevational view of the hose cleaner and holder of FIG. 6 used in removing dirt from a garden hose.

FIG. 7 illustrates schematically the use of the hose cleaner 10 to clean a garden hose 80. The first step is to locate a spot on the lawn or garden to place the hose cleaner 10. The support legs 72 may have sharp ends (not shown) that allow them to be pushed into the ground for support. FIG. 7 shows parallel legs 72, but they may be slightly tilted apart. In other applications, the support stakes 72 may be clamped to the bumper of a vehicle or attached to a fixed object such as a fence. In those cases, the support legs 72 may be replaced by other support components. If the support area has hard topsoil, a rag may be used to cover and protect the finish on the support portion 12, 14 and a rubber mallet may be used to drive the stakes 72 into the ground. After the stakes 72 are set in place, a little water may be used to wet the water-absorbent sponge-like resilient portion 60 for easier operation and efficient cleaning. The nozzle end of the dirty garden hose 80 is then inserted into the resilient opening 66 of the resilient portion 60 and pulled therethrough. As the hose 80 is pulled through the resilient portion 60 of the hose cleaner 10, the resilient opening 66 of the resilient portion 60 is deformed and compressed around the exterior of the hose 80 and removes debris and dirt from the hose 80. The front and rear sections 12, 14 secure the resilient portion 60 in the cavity 56 to prevent the resilient portion 60 from being pulled out of the hose cleaner 10. The hose cleaner 10 is simple and easy to use, can be attached to various objects, and has no moving parts.

In addition to cleaning, the hose cleaner 10 may also be used as a hose holder for supporting the hose 80 for various operations. For instance, the hose holder 10 may be positioned in the garden to guide the hose 80 away from the flowerbed to prevent the hose 80 from being dragged over the flowerbed and damaging the flowers. The hose holder 10 may also be used to support the hose 80 to water certain "hotspots" of the lawn. In that case, the hose 80 may be a sprinkler hose with a plurality of apertures therethrough for sprinkling water (not shown), or the hose may have a nozzle at its end for spraying a specific area. The hose holder 10 may also control the hose 80 at high pressure and keep the hose 80 from "snaking" when the water is turned on.

The above-described arrangements of apparatus and methods are merely illustrative of applications of the principles of this invention and many other embodiments and modifications may be made without departing from the spirit and scope of the invention as defined in the claims.

What is claimed is:

1. A hose cleaner for cleaning the exterior of a hose, the hose cleaner comprising a resilient portion coupled to a support portion, the resilient portion including a resilient, deformable material and a resilient opening being smaller in size than the exterior of the hose for receiving the hose, the support portion comprising channels for receiving support legs.

2. The hose cleaner of claim 1, wherein the exterior of the hose and the resilient opening have similar shapes.

3. The hose cleaner of claim 1, wherein the resilient, deformable material comprises rubber.

4. The hose cleaner of claim 1, wherein the resilient, deformable material comprises a water-absorbent material.

5. The hose cleaner of claim 4, wherein the water-absorbent material comprises sponge rubber.

6. The hose cleaner of claim 1, wherein the support portion comprises a cavity which is coupled to the resilient portion near an outer edge of the resilient portion.

7. The hose cleaner of claim 1, wherein the support portion comprises a pair of sections pressed against generally opposite sides of the resilient portion.

8. The hose cleaner of claim 7, wherein the pair of sections comprise a support opening which exposes the resilient opening and a portion of the resilient portion adjacent the resilient opening.

9. A hose cleaner and holder for use with a hose, comprising a resilient member and means for supporting the resilient member relative to the hose, the resilient member comprising a deformable resilient opening for receiving and pressing against the exterior of the hose, the means comprising a substantially rigid member coupled to an outer portion of the resilient member spaced from the deformable resilient opening, the substantially rigid member comprising a front section disposed on a front side of the resilient member and a rear section disposed on a rear side of the resilient member, the rear section coupled to the front section, the front section having a front opening larger in size than and exposing the deformable resilient opening and the rear section having a rear opening larger in size than and exposing the deformable resilient opening, the front section having a pair of front grooves and the rear section having a pair of rear grooves disposed opposite the front grooves.

10. The hose cleaner and holder of claim 9, wherein the deformable resilient opening is smaller in size than the exterior of the hose.

11. The hose cleaner and holder of claim 9, wherein the substantially rigid member comprises a cavity which receives the outer portion of the resilient member.

12. The hose cleaner and holder of claim 9, wherein the front section and the rear section are coupled together by fasteners.

13. The hose cleaner and holder of claim 9, wherein the pair of front grooves and the pair of rear grooves are for clamping, respectively, a pair of support legs therebetween.

* * * * *